United States Patent [19]

Roach et al.

[11] Patent Number: 4,878,267

[45] Date of Patent: Nov. 7, 1989

[54] RESISTING ENTRY OF AN OBJECT INTO A SPACE BETWEEN THE HINGED EDGE OF A DOOR MEMBER HINGEDLY ATTACHED TO A ASSOCIATED JAMB MEMBER AND A SURFACE OF THE JAMB MEMBER

[76] Inventors: James F. Roach, 28 Pine St., Carver, Mass. 02330; Kevin V. Roach, 363 Fosdick Rd., North Carver, Mass. 02330

[21] Appl. No.: 256,319

[22] Filed: Oct. 11, 1988

[51] Int. Cl.[4] ..... E05D 11/00

[52] U.S. Cl. ..... 16/250; 16/251; 16/DIG. 42; 49/383

[58] Field of Search ..... 16/250, 251, DIG. 42; 49/383

[56] References Cited

U.S. PATENT DOCUMENTS

| | | | |
|---|---|---|---|
| 1,444,398 | 2/1923 | Shepherd . | |
| 1,626,844 | 5/1927 | Kuhn | 49/383 X |
| 2,681,480 | 6/1954 | Dixon, Sr. | 49/383 |
| 2,694,234 | 11/1954 | Roby et al. | 49/383 |
| 2,910,741 | 11/1959 | Dettman | 49/383 |
| 3,302,690 | 2/1967 | Hurd | 49/383 X |
| 4,040,142 | 8/1977 | Ippolito | 16/251 |

FOREIGN PATENT DOCUMENTS

| | | | |
|---|---|---|---|
| 531236 | 10/1956 | Canada . | |
| 621236 | 5/1961 | Canada . | |
| 2019475 | 10/1979 | United Kingdom | 49/383 |

*Primary Examiner*—Nicholas P. Godici
*Assistant Examiner*—William Scott Andes
*Attorney, Agent, or Firm*—Charles Hieken

[57] ABSTRACT

A device for resisting entry of an object into a space between the hinged edge of a door and associated door jamb includes an elongated sheet of material thin enough to be placed in this space without impeding the closing of the door. The sheet has first and second strips adapted to be fixedly connected within the space to the door and jamb, respectively. A third strip interconnects the first and second strips and coacts therewith to resist entry of objects into the space when the door and jamb are brought together.

16 Claims, 2 Drawing Sheets

RESISTING ENTRY OF AN OBJECT INTO A SPACE BETWEEN THE HINGED EDGE OF A DOOR MEMBER HINGEDLY ATTACHED TO A ASSOCIATED JAMB MEMBER AND A SURFACE OF THE JAMB MEMBER

This invention concerns a device which can be mounted in the space between a door jamb and door to prevent fingers or other objects from being clamped, trapped or pinched within the space by resisting entry into the space.

Doors are commonly mounted in hinge pins secured to a door jamb member or to a wall with the door free to rotate about its hinges from an open to a closed position. It is common for young children and even adults to place their fingers within the space formed when the door is in the open position between the door and jamb and have that finger caught or pinched in the space when the door is closed. Similarly, a finger may be caught in the space formed between a closed door and the retaining wall when the door is moved to an open position. Because the force produced in these spaces is significant when the door acting as a lever moves toward the closed position, serious damage to a finger or the object in this space can occur.

Ippolito U.S. Pat. No. 4,040,142 discloses one prior art approach to this problem. Ippolito describes a device for covering the groove of an opening between doors which includes a bellows mounted opposite to the hinge access. The bellows prevents access to the groove when the door is open and falls into a flat profile when the door is closed. Robey et al. Canadian Patent No. 531,236 describes a pair of hinge guards which are fixed to either side of a swinging door formed from a sheet-like flexible material. Dettman U.S. Pat. No. 2,910,741 and Canadian Patent No. 621,236 similarly describe a pair of flexible strips fixed to either side of a swinging door. Shepherd U.S. Pat. No. 1,444,398 describes a hinge guard fixed to the outer portion of a hinged door. Odie et al. British Patent Application No. GB 2 019 475 A describes a strip of flexible polyethylene extended across the cap of a door which appears to fold together when the door is closed and to lie against the wall to which the door is fixed. Hurd U.S. Pat. No. 3,302,690 describes a pair of guards which are fixed on either side of a hinged door section. Kuhn U.S. Pat. No. 1,626,844 describes a guard fixed around the hinge of a foldable bus door.

In a first aspect, the invention features a device for preventing an object from being trapped or pinched in a space between the hinged edge of a swinging door member and the associated vertical jamb member. The device includes an elongated sheet of material thin enough to be placed within the space without affecting the closing of the door member to the jamb member. The sheet is formed with a first and second strip, the first strip being adapted to be fixedly connected within the space to the door member and the second strip being adapted to be fixed within the space to the jamb member. The first and second strips are connected together by a third strip which is adapted to cooperate with the first and second strips to prevent access to the space when the door member and jamb member are brought together.

In preferred embodiments, the first and second strips are connected by a fourth strip attached to cooperate with the first and second strips to prevent access to a second space between the door member and a wall hingedly connected to the door member when the door member and wall are caused to be brought together; the sheet is formed as a single sheet of material formed into a hollow tube; the sheet has a thickness of the order of 1/16 inch; the third strip is adapted to lie adjacent the door member when the door and jamb member are adjacent each other; the third strip is caused to balloon from the space when the door and jamb members are brought together; the fourth strip is adapted to balloon from the second space when the door and wall are brought together; the device is adapted to be fastened by adhesive within the space; and the device is formed of plastic.

In a second aspect, the invention features a method for preventing an object from being trapped in the space between the hinged edge of a swinging door member and the associated vertical jamb member. The method includes the step of providing an elongated sheet of material thin enough to be placed in the space without affecting the closing of the door member and the jamb member. The sheet is provided with first and second strips, the first strip being adapted to be fixedly connected within the space to the door member and the second strip being adapted to be fixedly connected within the space to the jamb member. Also provided is a third strip connected to the first and second strips and being adapted to cooperate with the first and second strips to prevent access to the space when the door member and jamb member are brought together; and fixing the elongated sheet of material within the space between the door member and jamb member such that the first strip is fixed within the space to the door member and the second strip is fixed within the space to the jamb member.

This invention provides a device which is readily manufactured and inexpensive to produce in a single piece construction, such as a plastic extrusion. No tools are required for installation, and the invention simultaneously prevents access to both the inner and outer spaces formed between a door and a wall. The whole of the space formed may be covered by this device. Since the device is adapted to be fixed to the door and wall within the space formed between the door and the wall, it may be fixed by adhesive and the closing of the door against the wall reinforces the adhesion of the device within the space each time the door is closed. Further, because the device is attached within the space between the door and the wall and can be formed of transparent or decoratively matched to the door and wall, it is relatively invisible when the door is open or closed. Because no screws, nails or other separate fastening means are required no damage is created to the door or wall when it is mounted or removed. The device is readily adapted to accommodate any number of hinges or hinge size and patterns. Preferably, the device has exposed portions that lie flat on the door or fold flat on the device when the door is closed.

Other advantages of the invention include the ability to produce the invention as extruded flat plastic which may be sold either in a flat pack or in loose coils rather than as an elongated rigid member. The device also has the advantage of increasing the energy efficiency, sound quality and weather resistance of any door. It may also be used on any new or existing doors without removal of the door during attachment. It can also be constructed from hinged metal. Since the device is reusable and transferable, doors can be readily refinished, and the device reattached. Relatively inexpensive double-sided clear compressing adhesive strips may be used for its attachment to any door. Because the device is attached to unexposed surfaces of the door and door jamb, tampering with the installation is difficult.

Other features and advantages of the invention will be apparent from the following detailed description and from the claims when read in connection with the accompanying drawing in which:

Figure 1:
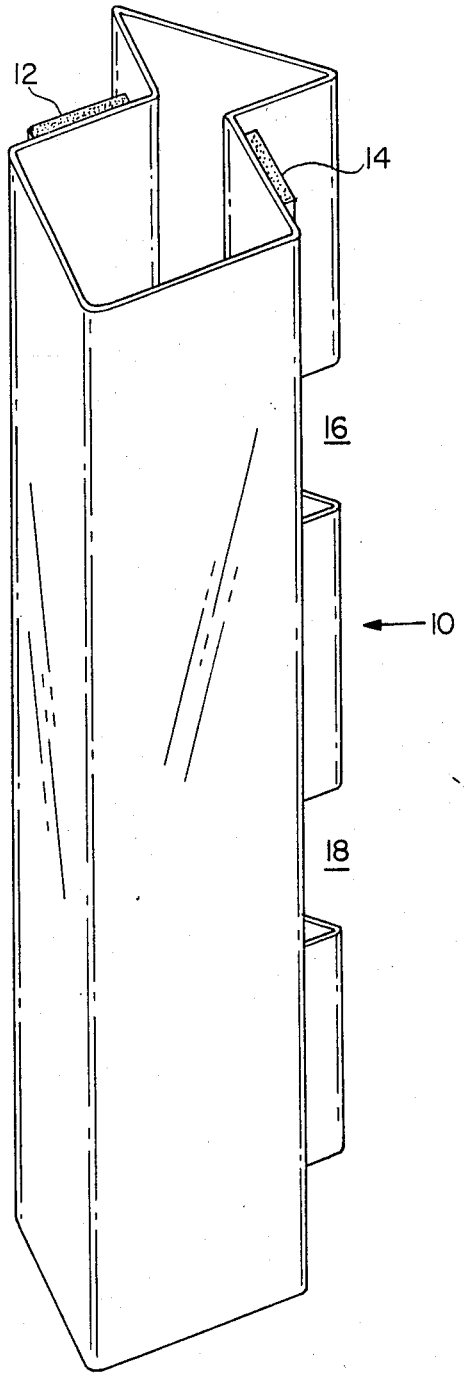
FIG. 1 is an isometric view of a device according to the invention.
Figure 1A:
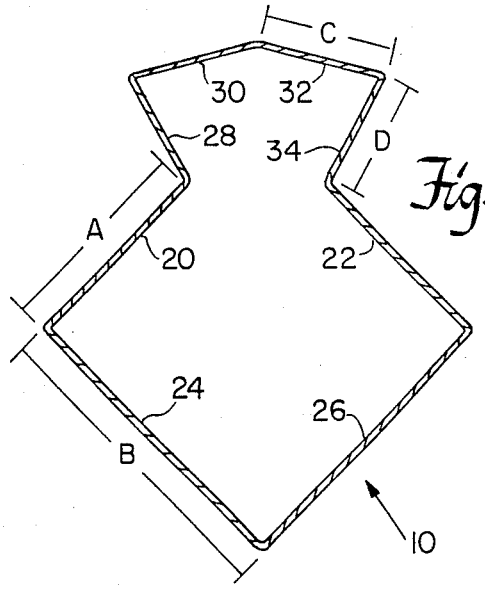
FIG. 1A is a transverse sectional view through section 1—1 of FIG. 1.

Referring to FIGS. 1 and 1A device 10 is formed of an extruded sheet of plastic of length between three and eight feet long, preferably about six feet long, with a transverse section as shown in FIG. 1A. Generally, device 10 is formed as a hollow tube to which are attached a pair of adhesive strips 12, 14 each including a protective peelable protective tape that may be removed just before attachment to a door or jamb surface. Tube 10 is interrupted by cutout regions 16, 18 sized to allow insertion of device 10 over door hinges.

Referring to FIG. 1A, the extruded plastic tube is formed as an eight-sided or faceted structure having two strips 20, 22 sized to fit against a wall and door member generally having a width A of $1\frac{3}{4}''$. Two other strips 24, 26 are attached to strips 20, 22 and have a length B about $2\frac{1}{2}''$ and are adapted to fold over each other when positioned in a door in a closed position and adapted to form a balloon when the door is being opened. Also provided are four other strips 28, 30, 32 and 34 adapted to prevent access to a space between the door and a wall as the door is opened. Generally strips 30 and 32 have a width C of about 1" and strips 28, 34 have a width D of about 1". Strips 20, 22 may be thinner than the other strips to facilitate installation in close fitting doors and coated with a pressure-sensitive adhesive.

Figure 2:
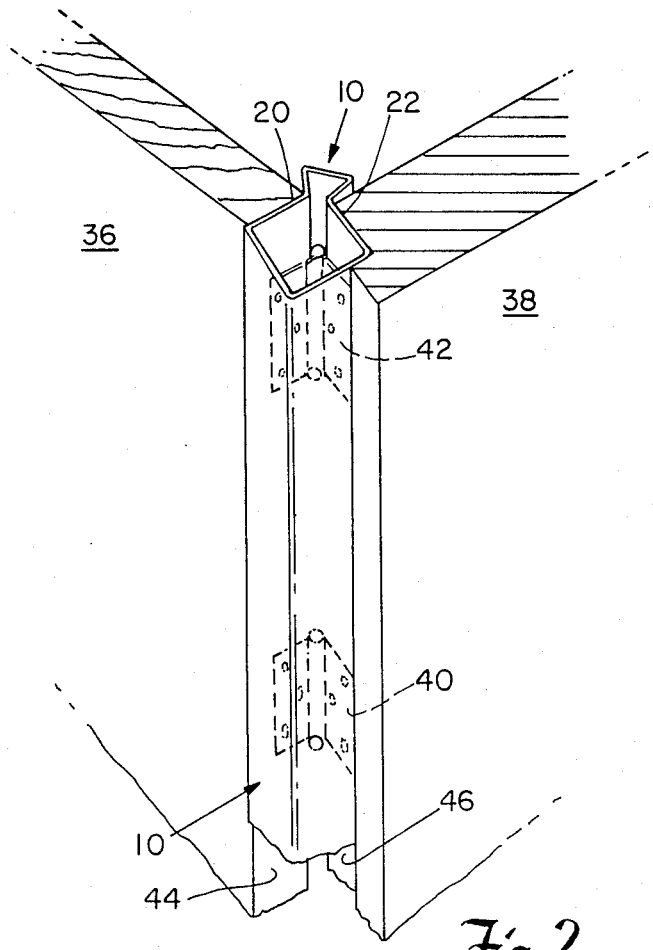
FIG. 2 is an isometric fragmentary view of a device positioned within the space between a door member and a wall according to the invention.

Referring to FIG. 2, device 10 is shown in position between a door 36 and a wall 38 attached by hinges 40, 42. Strips 20, 22 are attached respectively to the end 46 of wall 38 and to the edge 44 of door 36. Hinge cutouts 16, 18 (FIG. 1) are placed respectively over hinges 40, 42.

Figure 3:
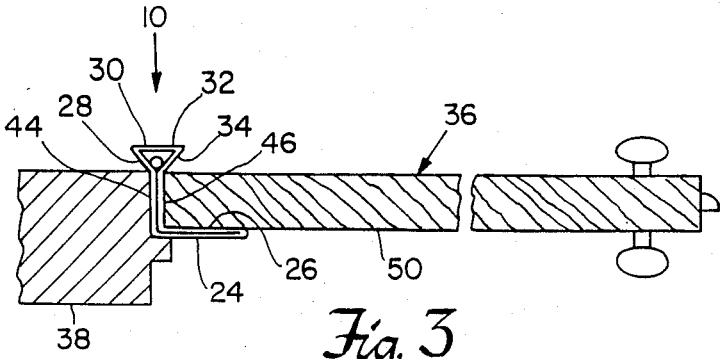
FIG. 3 is a transverse sectional view through section 3—3 of FIG. 2 but with the door closed.
Figure 4:
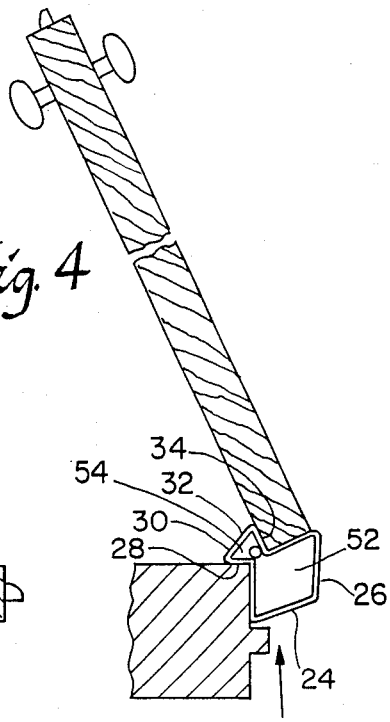
FIG. 4 is a transverse sectional view through section 3—3 of FIG. 2 with the door open.
Figure 5:
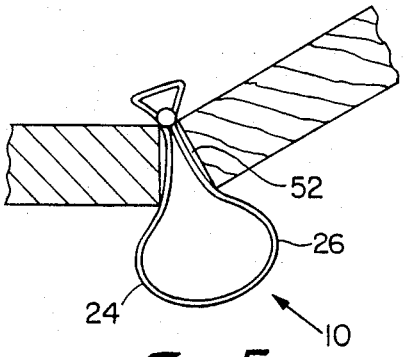
FIGS. 5 and 6 are transverse sectional views through a door wall and device according to the invention in various stages of opening of the door.
Figure 6:
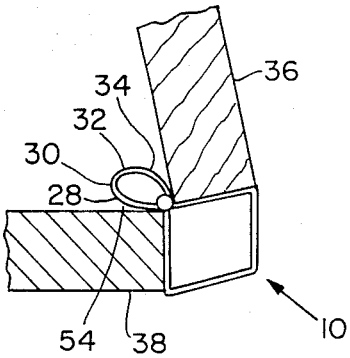
Figure 7:
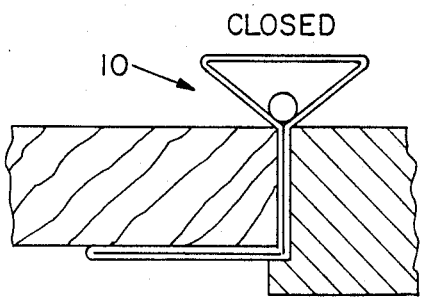
FIGS. 7 and 8 are transverse sectional views through a device according to the invention showing its configuration with the door closed and with the door open, respectively.
Figure 8:
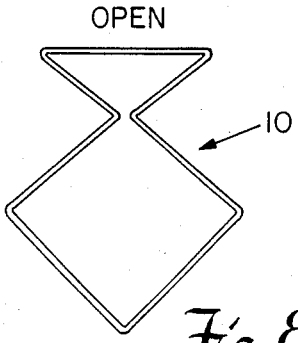

Referring to FIGS. 3, 4, 5 and 6, the cross sectional view of the door and wall and the corresponding configuration of device 10 is shown. FIG. 3 shows the position of the device when the door is closed and thus edge 46 of the door and edge 44 of the wall are adjacent each other. In this position device 10 has sheets 24, 26 closely applied to a side 50 of door 36. Sheets 28 through 34 are positioned in a relaxed condition about the other side of the door. In FIG. 5 sheets 24, 26 form a balloon-like structure as the door is being closed. This structure pushes any finger or other object which was within a gap 52 formed between the door and the wall outwardly from gap 52. Similarly, as shown in FIG. 6, sheets 28, 30, 32 and 34 form a balloon as the door is nearing a completely open position which causes any object within the gap 54 formed between the wall and door to be pushed from the gap 54. As shown in FIG. 4 when the door is in an intermediate position between the nearly open and nearly closed positions shown in FIGS. 6 and 5, respectively. Sheets 24, 26, 28, 30, 32 and 34 cannot be easily pushed by an object into space 52. FIGS. 7 and 8 show the profile of device 10' that has a seven-faceted cross section when the door is in the closed position as shown in FIG. 3 or when the door is in the open position as shown in FIG. 4.

Referring to FIG. 2, device 10 is readily placed between a door and wall by slipping strips 28, 30, 32 and 34 through the space between the door and wall and over hinges 40, 42. Adhesive surfaces on strips 20, 22 are then pushed against the edges 44, 46 of the wall and door to hold device 10 firmly in position. Door 36 is then closed tightly against wall 38 to cause the adhesive surfaces to be firmly pushed against edges 44, 46. Edges 44 and 46 are surfaces of door 36 and wall or jamb 38, respectively, that are unexposed when door 36 is closed as seen in FIG. 7. In order to remove device 10 the procedure is simply reversed.

The adhesive surface on strip 22 is pressed against surface 46 of wall 38 after removing the peelable protective tape. Then device 10 is held in a stable position while closing door 36 after removing a peelable protective tape over the adhesive surface of strip 20 to clamp strip 22 against surface 46 and strip 20 against surface 44 of door 36 in secure adhesive contact therewith.

Other embodiments are within the following claims. For example, device 10 can be constructed from a thin metal stock to provide a more hard wearing device for use in industrial or public places. If formed from plastic, the plastic is preferably clear but may be stained or colored and finished as appropriate to provide a color coordination with the door and wall members.

What is claimed is:

1. A device for resisting entry of an object into a space between the hinged edge of a door member hingedly attached to an associated jamb member and a surface of said jamb member, said device comprising, a door member;

a jamb member; and an elongated sheet of material thin enough to be placed in said space without impeding the closing of said door member to said jamb member, said sheet having a first and second strip, said first strip being fixedly connected within the said space to said door member on a surface thereof that is unexposed when said door is closed and said second strip being fixedly connected within said space to said jamb member on a surface thereof that is unexposed when said door is closed, said first and second strips being connected by a third strip attached to said first and second strips, said third strip cooperating with said first and second strips to resist entry into said space when said door member and jamb member are brought together.

2. The device of claim 1 wherein said first and second strips are connected by a fourth strip attached to said first and second strips, said fourth strip cooperating with said first and second strips to prevent access to a second space between said door member and a wall hingedly connected to said door member, when said door member and jamb member are caused to be brought together.

3. The device of claim 1 wherein said sheet is formed as a single sheet of material formed into a hollow tube.

4. The device of claim 2 wherein said sheet is formed as a single sheet of material formed into a hollow tube.

5. The device of claim 1 wherein said sheet has a thickness of the order of 1/16 inch.

6. The device of claim 2 wherein said sheet has a thickness of the order of 1/16 inch.

7. The device of claim 1 wherein said third strip lies adjacent said door member when said door member and said jamb member are adjacent each other in the closed position.

8. The device of claim 2 wherein said third strip lies adjacent said door member when said door member and said jamb member are adjacent each other in the closed position.

9. The device of claim 1 wherein said third strip is caused to balloon from said space when said door and jamb member are brought together.

10. The device of claim 2 wherein said third strip is caused to balloon from said space when said door and jamb member are brought together.

11. The device of claim 2 wherein said fourth strip is caused to balloon from said space between said door member and said jamb member when said door and jamb members are brought together.

12. The device of claim 1 being fastened within said space by adhesive surfaces on said first and second strips.

13. The device of claim 2 being fastened within said space by adhesive surfaces on said first and second strips.

14. The device of claim 3 being formed of plastic.

15. The device of claim 1 having exposed portions adapted to lie flat on the door or fold flat on the device when the door is closed.

16. A method for resisting entry of an object into a space between the hinged edge of a door member and a surface of the associated jamb member, comprising the steps of:

positioning in said space a device comprising an elongated sheet of material thin enough to be placed in said space without impeding the closing of said door member to said jamb member, said sheet having first and second strips, fixedly connecting said first strip within said space to said door member on a surface thereof that is unexposed when said door is closed, fixedly connecting said second strip within said space to said jamb member on a surface thereof that is unexposed when said door is closed, said first and second strips being connected by a third strip attached to said first and second strips, said third strip cooperating with said first and second strips to resist access to said space when said door member and jamb member are brought together;

whereby access to the space between the hinged edge of a door member and the associated jamb member or wall is resisted.

* * * * *